US005242773A

United States Patent [19]

Iino et al.

[11] Patent Number: 5,242,773

[45] Date of Patent: Sep. 7, 1993

[54] PHOTOSENSITIVE MEMBER HAVING FINE CRACKS IN SURFACE PROTECTIVE LAYER

[75] Inventors: Shuji Iino, Hirakata; Kenji Masaki, Ibaragi; Seishi Ojima, Takatsuki; Isao Doi, Toyonaka; Izumi Osawa, Ikeda, all of Japan

[73] Assignee: Minolta Camera Kabushiki Kaisha, Osaka, Japan

[21] Appl. No.: 788,931

[22] Filed: Nov. 7, 1991

[30] Foreign Application Priority Data

Nov. 8, 1990 [JP] Japan ..... 2-304995
Nov. 8, 1990 [JP] Japan ..... 2-304996

[51] Int. Cl.[5] ..... G03G 5/047; G03G 5/147

[52] U.S. Cl. ..... 430/58; 430/59; 430/66; 430/67

[58] Field of Search ..... 430/66, 67, 58, 59

[56] References Cited

U.S. PATENT DOCUMENTS 4,732,834 3/1988 Honda et al. ..... 430/84
4,804,607 2/1989 Atsumi et al. ..... 430/67
4,933,247 6/1990 Osawa et al. ..... 430/66
4,952,473 8/1990 Suzuki ..... 430/67
5,082,756 1/1992 Doi ..... 430/67

FOREIGN PATENT DOCUMENTS 311259 12/1988 Japan ..... 430/66
2-191964 3/1989 Japan .
201450 8/1990 Japan ..... 430/66

*Primary Examiner*—Roland Martin
*Attorney, Agent, or Firm*—Burns, Doane, Swecker & Mathis

[57] ABSTRACT

The present invention relates to a photosensitive layer comprising:

a substrate;

a photosensitive layer formed on the substrate;

a surface protective layer formed on the photosensitive layer, the surface protective layer being a deposited layer formed by a vacuum vapor deposition method to have no less than 400/cm$^2$ solvent-penetrable spots formed in its thickness direction.

7 Claims, 3 Drawing Sheets

PHOTOSENSITIVE MEMBER HAVING FINE CRACKS IN SURFACE PROTECTIVE LAYER

BACKGROUND OF THE INVENTION

1. Field of the Invention

The present invention relates to an organic photosensitive member excellent in durability having a vacuum thin layer as a surface protective layer.

2. Description of the Prior Art

Recently photosensitive members for electrophotography which are made by dispersing an organic photoconductive material to a binding resin have been widely utilized.

This type of photosensitive members are free of hygienic problems and profitable in industrial productivity by virtue of their excellent processing characteristics in comparison with photosensitive members formed of selenium or cadmium sulfide.

However, these organic photosensitive members are generally so poor in hardness that they are liable to be shaved or injured by the friction with transfer paper, cleaning materials, developer and others when used repeatedly.

A technology has been known to form a surface protective layer over the organic photosensitive layer for solving this problem.

As one of such surface protective layers, a vacuum thin layer made of an appropriate compound has been proposed.

It is possible to make a vacuum thin layer with a high hardness, and an organic photosensitive member having such a vacuum thin layer over the organic photosensitive layer as the surface protective layer will show higher durability in comparison with an organic photosensitive member without a surface protective layer, and will keep sufficient layer hardness in usage for a long period under ordinary temperature and humidity. However, in repeated usage electric charge tends to be accumulated on the interface between the surface protective layer and photosensitive layer with the result of rise of residual potential, lowering of sensitivity, and occurrence of black thread-like image noise.

SUMMARY OF THE INVENTION

The object of the present invention is therefore to provide a photosensitive member which in repeated usage does not show rise of residual potential, lowering of sensitivity, and occurrence of black threadlike image noise.

The present invention relates to a photosensitive member comprising:

a substrate;

a photosensitive layer formed on the substrate;

a surface protective layer formed on the photosensitive layer, the surface protective layer being a deposited layer formed by a vacuum vapor deposition method to have no less than 400/cm$^2$ solvent-penetrable spots in its thickness direction.

DETAILED DESCRIPTION OF THE INVENTION

Figure 1:
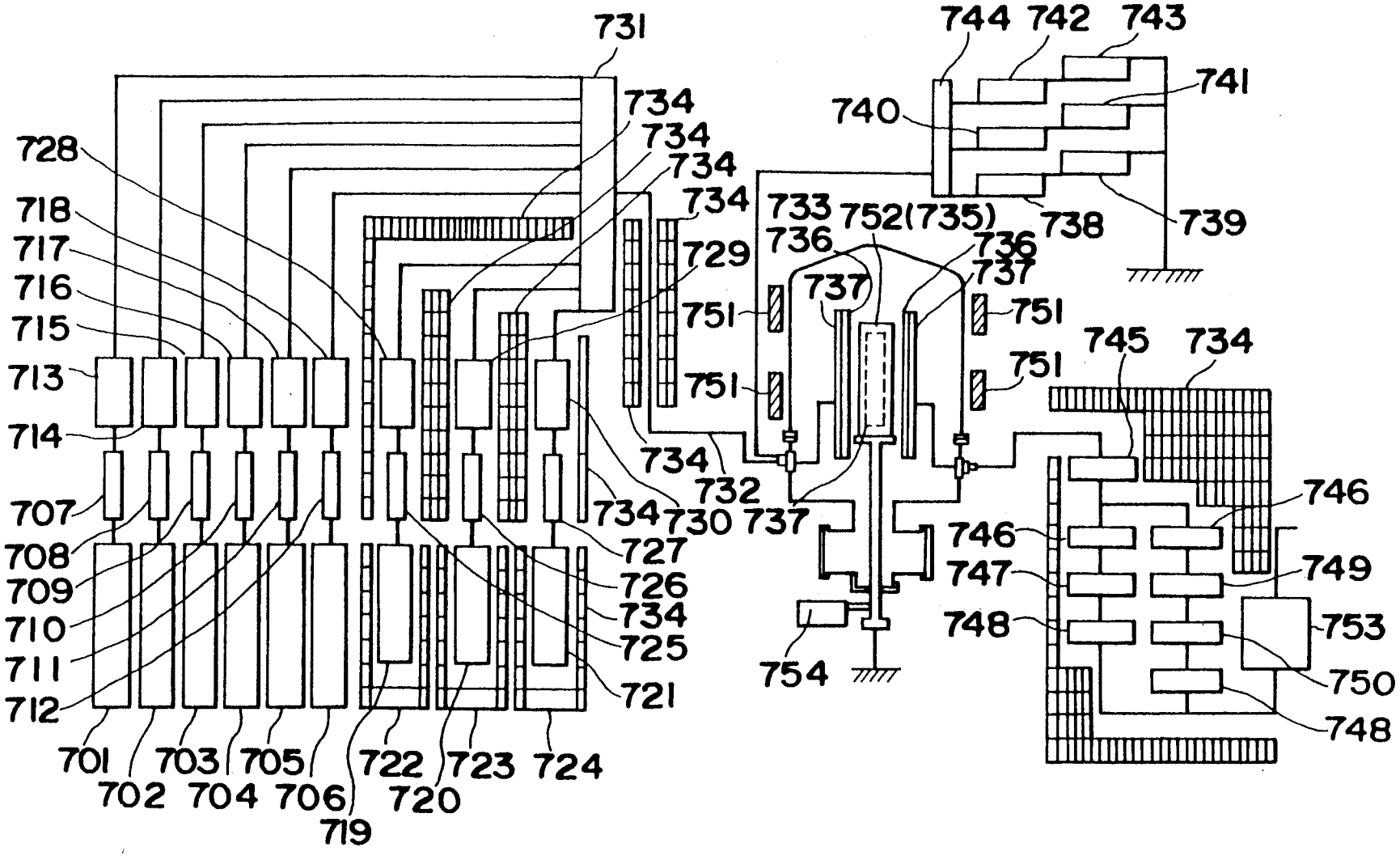
FIG. 1 is a schematic diagram of an apparatus for making a vacuum thin layer.

The present invention is to provide a photosensitive member that does not show the lowering of sensitivity and the occurrence of black thread-like noise in repeated usage.

The present invention has been accomplished by forming minute holes or fine cracks in a vacuum thin layer serving as a surface protective layer, which pass therethrough to reach a photosensitive layer located below the surface protective layer.

Thus, the present invention relates to a photosensitive member comprising:

a substrate;

a photosensitive layer formed on the base plate;

a surface protective layer formed on the photosensitive layer, the surface protective layer being a deposited layer formed by a vacuum vapor deposition method to have no less than 400/cm$^2$ solvent-penetrable spots in its thickness direction.

The photosensitive member of the present invention comprises, at least, an electrically conductive substrate, an organic photosensitive layer, and a vacuum thin layer serving as a surface protective layer. Below are given explanations in the order.

The photosensitive layer is made by forming a well-known organic photosensitive layer on the electrically conductive substrate, and the internal structure of the photosensitive layer may be a monolayer type in which a photoconductive material and a charge-transporting material are dispersed in a binder resin, a separated function type in which a charge-generating layer and a charge-transporting layer are formed on an electrically conductive substrate in this order or another separated function type in which a charge-transporting layer and a charge-generating layer are formed in this order.

Over the surface of the organic photosensitive layer is formed a vacuum thin layer for serving as a surface protective layer.

As the surface protective layer is exemplified by amorphous hydrocarbon layers formed by plasma polymerization or metal compound layers formed by a vapor deposition method, a spattering method, an ion plating method and other so-called vacuum thin layer-making techniques from such metal compounds as $Al_2O_3$, $Bi_2O_3$, $Ce_2O_3$, $Cr_2O_3$, $In_2O_3$, MgO, SiO, $SiO_2$, $SnO_2$, $Ta_2O_3$, TiO, $TiO_2$, $ZrO_2$, $Y_2O_3$ and other oxides, $Si_3N_4$, $Ta_2N$ and other nitrides, $MgF_2$, LiF, $NdF_3$, $LaF_2$, $CaF_2$, $CeF_2$ and other fluorides, SiC, TiC and other carbides, and ZnS, CdS, PbS and other sulfides.

In the case of making a surface protective layer by a method of plasma polymerization, spattering, ion plating or the like, it is proposed that a resin layer is formed on a photosensitive layer to prevent the photosensitive layer under a protective layer from deterioration due to impact by electrons or ions or to heat or other factors in a plasma (see, for example, Japanese Patent Laid-Open Publication Hei-1 133063). For the photosensitive members with such a structure, irrespective of the kind of photosensitive layer employed, the application of the present invention will improve durability, lowering of sensitivity (occurrence of black threads) and durability with respect to copy after long copying operation.

In the present invention, solvent-penetrable spots are formed in a vacuum thin layer formed on or over an organic photosensitive layer.

The solvent-penetrable spots are so minute holes or fine cracks not to be observed by means of optical or electron microscope. The reason why they are not observed by means of optical microscope is due to extremely high transparency of the vacuum thin layer, which is required to allow visible light to pass through the layer. The reason why they are invisible by means of electron microscope is due to the fact that vapor deposition of gold over the vacuum thin layer performed before the watching fills up the solvent-penetrable holes.

Such solvent-penetrable spots may be recognized first by dropping a certain solvent onto the vacuum thin layer so as to make materials constituting the organic photosensitive layer, located below the vacuum thin layer, (the resin layer in case a resin layer is formed between the surface protective layer and photosensitive layer) to penetrate therethrough to be on the vacuum thin layer.

The solvent to be dropped is not specifically limited provided that it can dissolve the organic photosensitive layer, and it may be selected depending on the kind of the organic photosensitive layer.

When an excessive volume of the solvent is dropped to the vacuum thin layer having a large number of the solvent-penetrable spots, the photosensitive materials exuded from a plurality of spots may come together into a single mass, thus the number of the solvent-penetrable spots can not be counted accurately. It is advised that solvents with higher dissolving ability should be used in relatively smaller volume than those with lower dissolving ability.

More concretely the following is an example of counting methods of the spots.

A 1 $cm^2$ sheet of filter paper is placed on a photosensitive member and 20 $\mu l$ of acetone is dropped onto it. After allowed to stand for 30 seconds at 25° C., the filter paper is removed. The materials in an organic photosensitive layer locating below the photosensitive layer exude through penetrating holes. When observed by means of optical microscope, the materials in the photosensitive layer are recognized to be solidified by desiccation and scattered. It is possible to count the number of the solvent-penetrable spots by assuming that the solidified mass represents a solvent-penetrable spot.

In the present invention, such solvent-penetrable spots are formed in the vacuum thin layer in number of not less than 400/$cm^2$, preferably not less than 1000/$cm^2$ and further preferably not less than 2000/$cm^2$. When they are formed less than 400/$cm^2$ to result in increase of residual potential, lowering sensitivity and generation of black thread-like image noise.

The photosensitive member in which a vacuum thin layer containing solvent-penetrable spots is formed on an organic photosensitive layer becomes to be free from such problems as lowering of sensitivity, increase of residual potential, and black threads in copied image.

These effects are considered to be due to leakage of electrical charges accumulated at the interface between a vacuum thin layer and a photosensitive layer through solvent-penetrable spots with the result that electrical charges are not accumulated, residual potential does not increase and occurrence of black threads is prevented.

Examples of methods of forming the solvent-penetrable spots include the one making holes mechanically by pressing onto surface of a photosensitive member innumerable needles, highly hard particles or hair-planted paper, the one forming poorly adhered portions between a vacuum thin layer and a photosensitive layer or resin layer in high density so as to allow the vacuum thin layer to peel finely, and the one making highly dense and fine cracks by utilizing stress inherent to a vacuum thin layer. However, the methods are not specifically limited so far as they can provide dense formation of minute holes in a vacuum thin layer, which allow solvent to penetrate therethrough.

In the case of making highly dense formation of fine cracks by utilizing the stress inherent to the vacuum thin layer, the surface of the photosensitive layer is roughened to form hollows and concaves and a vacuum thin layer is deposited on it so as to make the stress to concentrate on the hollows and concaves of the surface. Thereby, there are formed innumerable fine cracks within the vacuum thin layer, which constitute the spots allowing the penetration of solvents.

It is preferable to make a vacuum thin layer 0.01 to 5 $\mu m$ thick for easier formation of fine cracks. The extent of roughness of the photosensitive layer is preferably adjusted so that the maximum height (Rt) ($\mu m$) of the vacuum thin layer after deposition on the roughened surface may be 0.05 to 0.4 $\mu m$ and the mean mountain distance (Sm) ($\mu m$) in the rough surface may be not longer than 30 $\mu m$.

The rough surface may be obtained preferably by a mechanical abrasion method using buff, brush or the like, or by a sand-blasting technique in which abrasive particles are blasted onto surface of a photosensitive layer.

The maximum height (Rt) and the mean mountain distance (Sm) are estimated according to the method described in JIS-B 0601-1982 in the present invention. The values (Rt and Sm) concerning the roughness of the surface mentioned are arithmetic means of the values estimated on the parts (more than 3 parts) randomly withdrawn from surface of a photosensitive member.

Figure 4:
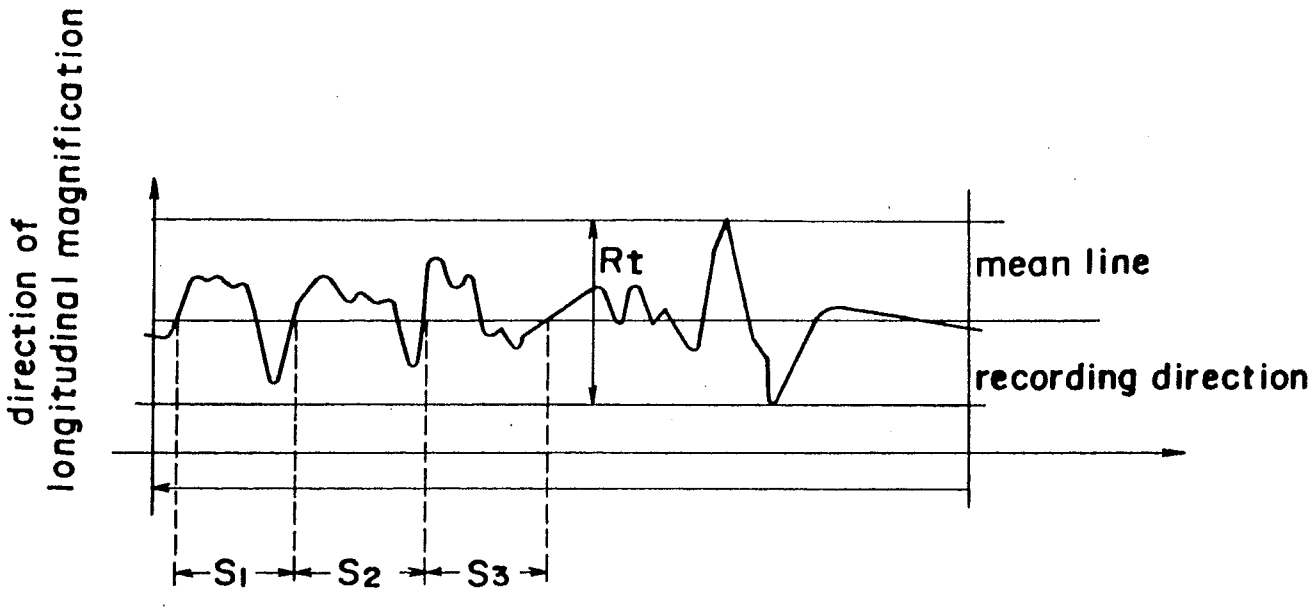
FIG. 4 is a diagram for explaining surface roughness.

Now referring to FIG. 4, more detailed explanation is given. The maximum height (Rt) is obtained by drawing 2 lines parallel to the mean line to hold the roughness curve withdrawn by a standard length, measuring the distance of the 2 lines in the direction of longitudinal magnification in the sectional curve and expressing the obtained values in micrometer ($\mu m$).

The "roughness curve" here denotes the curve obtained by cutting off the wavy component on the surface, longer than 0.025 mm of wave length, from the sectional curve (which is the outline appearing on the cut edge when an object to be estimated is cut).

The "standard length" is the length of the part withdrawn from the sectional curve by a definite length. In the present invention, the standard length is 2.5 mm.

The "mean line" is the line in the part withdrawn from the roughness curve by the standard length and it is set so that its sum of squares of the deviation from the roughness curve may become minimum.

The mean mountain distance (Sm) in the rough surface is the mean value, expressed in $\mu m$, of the sum of the distances (S1, S2 . . ., in FIG. 4) between the neighboring peak and valley in the roughness curve. Sm corresponds to the density of fineness of irregularities.

Below are given examples of the present invention for more detailed explanation.

Preparation of organic photosensitive layer (a) (function-separated type for negative changeability)

A mixed solution of 1 part by weight of a bisazo pigment chlorodianblue (CDB), 1 part by weight of a polyester resin (V-200, made by Toyobo K.K.) and 100 parts by weight of cyclohexane was dispersed by using a sand grinder for 13 hours. This solution was applied over a cylindrical aluminum substrate (80 mm in diameter ×330 mm in length) by a dipping technique, and dried to form a charge generating layer of 0.3 μm thickness.

Separately, 1 part by weight of 4-diethylaminobenzaldehyde diphenylhydrazone (DEH) and 1 part by weight of polycarbonate (K-1300; made by Teijin Kasei K.K.) were dissolved in 6 parts by weight of tetrahydrofuran. The obtained solution was used to coat the above charge-generating layer and dried to form a charge-transporting layer of 15 μm thickness. Thus, an organic photosensitive layer (a) was obtained.

Preparation of organic photosensitive layer (b) (mono-layer type for negative chargeability)

A mixed solution of 25 parts by weight of special α-form copper pathalocyanine (made by Toyo Ink K.K.), 50 parts by weight of a thermosetting acrylmelamine resin (made by Dainippon Ink K.K.; a mixture of A-405 and Super Beckamine J820), 25 parts by weight of 45-diethylaminobenzasldehyde-diphenylhydrazone and 500 parts by weight of an organic solvent (a mixture of 7 parts by weight of xylene and 3 parts by weight of butanol) was pulverized and dispersed in a ball mill for 10 hours. This dispersion was applied over a cylindrical aluminum substrate (80 mm in diameter×330 mm in length) by a dipping technique, dried and baked (at 150° C. for 1 hours). Thus, an organic photosensitive layer (b) of 15 μm thickness was obtained.

Examples 1 to 12 and comparative examples 1 to 2

The above prepared organic photosensitive layers (a) was treated as described below (referred to as treatment (i)).

A lowly volatile silicone oil, Toray Silicone SH550 (made by Toray Silicone K.K.) was impregnated into a hair-planted paper, ELEGAN/FK (tradename; made by Dainick K.K.).

The hair-planted paper was used to wrap a cylindrical roller (40 mm in diameter). This hair-planted roller and the photosensitive drum were made contact with each other at a linear pressure of 5gw/cm, and the photosensitive drums rotated at a speed of 60 rpm while the hair-planted roller was rotated at such a speed as to keep the relative speed to the photosensitive drum zero at the contacting point.

By adjusting the rotation speed and the linear pressure of the photosensitive drum to the hair-planted roller, the density of solvent-penetrable spots was varied.

On the photosensitive layer which was pretreated in the manner described above, a vacuum thin layer was formed as described below.

After the formation of the vacuum thin layer, the obtained photosensitive member was allowed to stand for 40 hours in an environment of temperature 40° C. and relative humidity (RH) 80%.

Solvent-penetrable spots in the photosensitive member were counted. The number of the spots was 100/cm$^2$ to 1000000/cm$^2$. Actual densities of the spots in all examples and comparative examples were shown in Table 1.

Preparation of plasma amorphous hydrocarbon layer (PAC)

In the glow discharge decomposition apparatus shown in FIG. 1, the inner part of a reactor (733) was evacuated to obtain so high a vacuum as $10^{-6}$ Torr, and first and second control valves (707 and 708) were respectively opened to allow hydrogen gas to flow from a first tank (701) into a fist flow rate controller (713) and butaidene gas from a second tank (702) into a second flow rate controller (714), both at 1.0 kg/cm$^2$ of output pressure. The flow rate controllers were adjusted to make hydrogen gas flow at the rate of 300 sccm and butaidene gas at the ate of 30 sccm, and both gases were flown into the reactor (733) through a main pipe (732) passing a mixer (731) on the way. Water the flow rate of both gases were stabilized, the pressure control valve (735) was adjusted to make the internal pressure of the reactor 0.5 Torr. On the other hand, the above-mentioned organic photosensitive layer was used as a substrate (752) and previously heated to 50° C. Under the conditions of stabilized gas flow rate and pressure, a electric power for low frequency (741) which had previously been connected to a selective connecting switch (744) was turned on and a power of 180 W was applied to a power-applying electrode (736) at a frequency of 100 KHz to conduct plasma polymerization for about 180 seconds for the formation of an amorphous carbon layer (PAC) of 1200 Å thickness, as a surface protective layer on the substrate (752). After the layer was formed, the power application was stopped, the control valve closed and the reactor (733) was extensively exhausted before the vacuum as broken and a photosensitive member of the present invention was taken out.

EXAMPLE 13

An amorphous hydrocarbon layer (PAC) on the surface of the photosensitive layer (b) was prepared in a manner similar to Example 1, except that the organic photosensitive layer was used instead of the photosensitive layer (a).

EXAMPLE 14

A photosensitive layer was prepared in a manner similar to Example 1 except that an aluminum oxide layer described below was formed as a vacuum thin layer serving as a surface protective layer.

Preparation of aluminum oxide layer (called ALO layer)

An ordinary spattering apparatus was operated under the conditions specified below:

| | |
|---|---|
| Target: | $Al_2O_3$ |
| Temperature of substrate: | 50° C. |
| Discharge distance: (distance between target and substrate) | 50 mm |
| Vacuum: | $2 \times 10^{-4}$ Torr |
| Discharge gas: | Ar |
| Discharge power: | 2.0 KW |
| Discharge frequency: | 13.56 MHz |
| Discharge time: | 12 minutes |
| Layer thickness: | 1800 Å |

EXAMPLE 15

A photosensitive layer was prepared in a manner similar to Example 1 except that a silicon oxide layer described below as formed as a vacuum thin layer serving as a surface protective layer.

Preparation of silicon oxide layer (SIO layer)

An ordinary vapor deposition apparatus for a vacuum heating method was operated under the conditions shown below to obtain a thin layer of SiO.

| | |
|---|---|
| Vapor source: | SiO |
| Temperature of substrate: | 50° C. |
| Temperature of boat: | 1200° C. |
| Vacuum: | $8 \times 10^{-5}$ Torr |
| Vapor depositing time: | 5 minutes |
| Layer thickness: | 1300 Å |

Examples 16 to 17 and comparative Examples 3 to 4

After the preparation of the organic photosensitive layer (a) or (b), the treatment (i) was omitted before the formation of the above-described vacuum thin layer (PAC), and then the processing described below (referred to as treatment (ii)) was performed.

The photosensitive member with a vacuum thin layer as a surface protective layer was pressed against the numerous needles supported by a rubber body (referred to as needlepoint holder for posttreatment) ( density of planted needles: 10/cm$^2$) to make minute holes in the vacuum thin layer. The density of holes in the vacuum thin layer was controlled by the number of times of pressing the needlepoint holder for posttreatment.

The count of solvent-penetrable spots in different photosensitive members showed that the density of the spots was 40/cm$^2$ to 1000/cm,$^2$. Estimated densities in examples and comparative examples are shown in Table 1.

The sensitivity was evaluated on the photosensitive member obtained in the examples 1 to 17 and the comparative examples 1 to 5 (neither of treatment (i) or (ii) was applied in comparative example 5).

The obtained photosensitive members were mounted on an copying machine, and exposure was adjusted to form half-tone copied images with an image density of 0.50.

Then after taking 10,000 A4-sized copies, a half tone picture image was obtained by the identical exposure and its image density was estimated to see the difference from the initial image density of 0.50.

For example, when the image density after taking 10,000 copies is 0.55, it was judged that the sensitivity had fallen by 0.05.

The surface potential of the copying machine was set to 600 [V] and the developing bias voltage to 150 [V].

Evaluation of the sensitivity fall included in Table 1 was made by the standards shown below.

Measurement of image density was done by using Sakura Densitometer PDA65 (trade name; made by Konica K.K.).

| Difference of image density | Symbol | Evaluation |
|---|---|---|
| <0.1 | ∘ | Good; no sensitivity fall observed. |
| 0.1 to 0.2 | Δ | No practical problem; some sensitivity fall observed. |
| >0.2 | x | Not desirable; sensitivity fall evident. |

The above results are summarized in Table 1.

TABLE 1

| Example | Organic photosensitive layer | Kind of surface protective layer | Treating method | Density of solvent penetrable spots (/cm$^2$) | Evaluation of sensitivity fall |
|---|---|---|---|---|---|
| Example 1 | (a) | PAC | (i) | 6000 | ∘ 0.05 |
| Example 2 | (a) | PAC | (i) | 10000 | ∘ 0.05 |
| Example 3 | (a) | PAC | (i) | 20000 | ∘ 0.05 |
| Example 4 | (a) | PAC | (i) | 40000 | ∘ 0.05 |
| Example 5 | (a) | PAC | (i) | 60000 | ∘ 0.05 |
| Example 6 | (a) | PAC | (i) | 100000 | ∘ 0.05 |
| Example 7 | (a) | PAC | (i) | 200000 | ∘ 0.05 |
| Example 8 | (a) | PAC | (i) | 400000 | ∘ 0.05 |
| Example 9 | (a) | PAC | (i) | 1000000 | ∘ 0.05 |
| Example 10 | (a) | PAC | (i) | 2000 | ∘ 0.06 |
| Example 11 | (a) | PAC | (i) | 1000 | ∘ 0.10 |
| Example 12 | (a) | PAC | (i) | 400 | Δ 0.20 |
| Comparative example 1 | (a) | PAC | (i) | 200 | x 0.35 |
| Comparative example 2 | (a) | PAC | (i) | 100 | x 0.70 |
| Example 13 | (b) | PAC | (i) | 6000 | ∘ 0.05 |
| Example 14 | (a) | ALO | (i) | 6000 | ∘ 0.06 |
| Example 15 | (a) | SIO | (i) | 6000 | ∘ 0.05 |
| Example 16 | (a) | PAC | (ii) | 1000 | ∘ 0.09 |
| Example 17 | (a) | PAC | (ii) | 400 | Δ 0.19 |
| Comparative example 3 | (a) | PAC | (ii) | 100 | x 0.70 |
| Comparative example 4 | (a) | PAC | (ii) | 40 | x 1.30 |
| Comparative example 5 | (a) | PAC | None | <10 | x 1.5 |

EXAMPLE 18

In this example, fine cracks were formed by utilizing the internal stress inherent to a vacuum thin layer and the number of solvent-penetrable spots provided by these cracks was set to be not less than 400.

Figure 2:
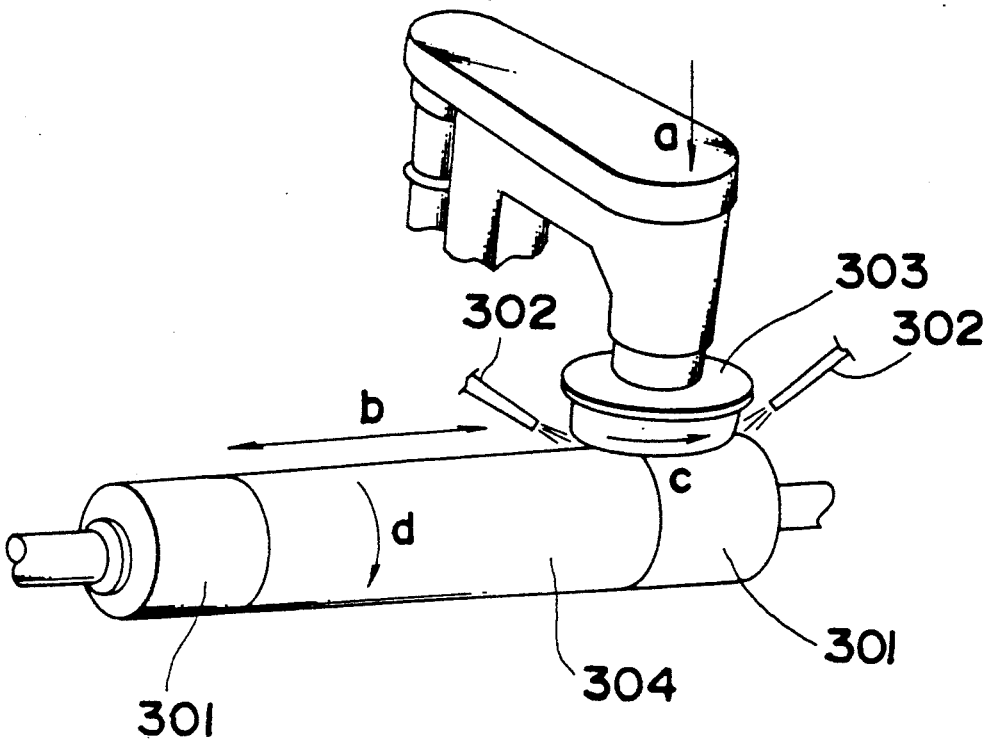
FIG. 2 is a schematic diagram of a method of buff abrasion.
Figure 3:
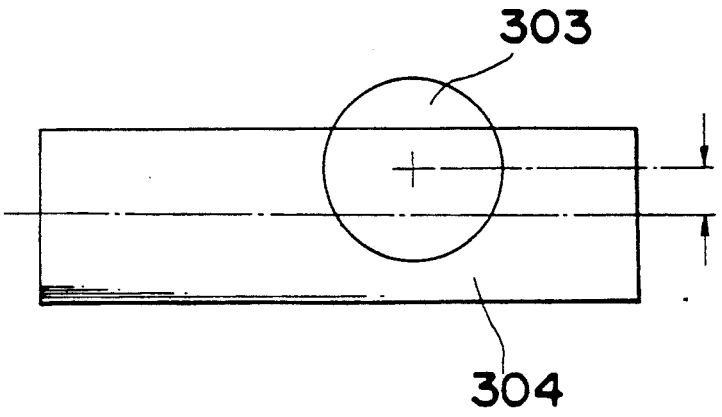
FIG. 3 is a diagram for explaining a relative positions of buff and photosensitive member in the method of buff abrasion.

Actually, as shown in FIG. 2, the organic photosensitive layer (a) was fixed by a chucking (301) and a disc buff (20 cm in diameter) of wool felt (303) was installed at the position of the definite buff deviation. The deviation means the distance, as shown in FIG. 3, between the center line in the longitudinal direction of the photosensitive member (304) and the center of disc buff (303).

Then, the photosensitive member (304) was rotated in the direction of arrow d (working rotation) and while the disc buff was rotated in the direction of arrow c, a load (buff load) was applied from the direction of arrow a to the disc buff (303) so as to press the disc buff (303) onto the photosensitive member (304) and to reciprocate the buff (buff feed). Taking timing to the motion of buff, pure water or pure water containing a dispersed abrasive powder was discharged from the discharging nozzle (302) toward the contact surface of the photosensitive member and the disc buff.

In this example, the buff deviation was 4.5 cm, working rotation 300 rpm, buff rotation 500 rpm, buff load 6.6 kg and buff feed 60 cm/min.; alumina ($Al_2O_3$) was used as an abrasive.

An amorphous hydrocarbon layer (PAC) was formed on the photosensitive layer in a manner similar manner to that described in example 1.

The photosensitive member thus obtained had the solvent-penetrable spots in a density of 5000/cm$^2$. The maximum height (Rt) of the surface (arithmetic mean in more than 3 randomly withdrawn parts) was estimated to be 0.12 ($\mu$m) and the mean mountain distance (Sm) 12 ($\mu$m).

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A photosensitive member comprising:

a substrate;

an organic photosensitive layer formed on the substrate; and a continuous surface protective layer formed on the organic photosensitive layer, the surface protective layer being a deposited layer formed by a vacuum vapor deposition method to have no less than 400/cm$^2$ solvent-penetrable spots in its thickness direction.

2. A photosensitive member as claimed in claim 1, wherein a resin layer is further formed between the organic photosensitive layer and the surface protective layer and the surface protective layer is a deposited amorphous carbon layer formed by a plasma polymerization-vacuum vapor deposition method.

3. A photosensitive member as claimed in claim 1, wherein the surface of the organic photosensitive layer opposite to the interface in contact with the substrate is made irregular and the surface protective layer is 0.001 to 5 $\mu$m thick.

4. A photosensitive member as claimed in claim 3, wherein the maximum height (Rt) of the irregular surface is 0.05 to 0.4 $\mu$m and the mean mountain distance (Sm) is not longer than 30 $\mu$m.

5. A photosensitive member as claimed in claim 4, wherein the surface of the organic photosensitive layer opposite to the interface in contact with the substrate is made irregular by roughing by a mechanical abrasion method.

6. A photosensitive member as claimed in claim 4, wherein the surface of the organic photosensitive layer opposite to the interface in contact with the substrate is made irregular by roughing by a sand blasting method.

7. A photosensitive member as claimed in claim 1, wherein said organic photosensitive layer comprises: an organic photosensitive monolayer comprising a charge transporting material and a charge generating material dispersed in a binder resin; or an organic photosensitive bilayer comprising a charge transporting layer and a charge generating layer.

* * * * *